US007827695B1

(12) United States Patent
Kim

(10) Patent No.: US 7,827,695 B1
(45) Date of Patent: Nov. 9, 2010

(54) HAIR-SLICING ELECTRIC RAZOR

(76) Inventor: Young Kim, 208 Midland Ave., Wayne, PA (US) 19087

( * ) Notice: Subject to any disclaimer, the term of this patent is extended or adjusted under 35 U.S.C. 154(b) by 456 days.

(21) Appl. No.: 11/895,842

(22) Filed: Aug. 28, 2007

Related U.S. Application Data

(60) Provisional application No. 60/850,989, filed on Oct. 11, 2006.

(51) Int. Cl.
*B26B 19/00* (2006.01)
*B26B 21/14* (2006.01)
*B26B 21/00* (2006.01)

(52) U.S. Cl. ..... 30/43.3; 30/62; 30/529

(58) Field of Classification Search ..... 30/43.3, 30/62, 529
See application file for complete search history.

(56) References Cited

U.S. PATENT DOCUMENTS

| | | | | | |
|---|---|---|---|---|---|
| 2,219,090 | A | * | 10/1940 | Henderson | 30/43.3 |
| 2,220,800 | A | * | 11/1940 | Jepson | 30/43.5 |
| 2,355,672 | A | * | 8/1944 | Page | 30/43.5 |
| 2,423,595 | A | * | 7/1947 | Hall | 30/43.1 |
| 2,440,114 | A | * | 4/1948 | Page | 30/43.3 |
| 3,027,635 | A | * | 4/1962 | Frith | 30/43.5 |
| 3,045,344 | A | * | 7/1962 | Cholet | 30/43.6 |
| 3,143,797 | A | * | 8/1964 | Shoemaker | 30/43.5 |
| 3,947,961 | A | * | 4/1976 | Meyer | 30/41 |
| 4,038,749 | A | * | 8/1977 | Yamada et al. | 30/43.92 |
| 4,115,920 | A | * | 9/1978 | Ascoli | 30/43.3 |
| 5,678,313 | A | * | 10/1997 | Tezuka et al. | 30/43.92 |
| 6,154,962 | A | * | 12/2000 | Ilkhanov | 30/34.1 |
| 6,442,840 | B2 | | 9/2002 | Zucker | |
| 6,584,691 | B1 | * | 7/2003 | Gerasimov et al. | 30/43.6 |
| 6,675,480 | B2 | | 1/2004 | Oswald | |
| 6,789,322 | B2 | | 9/2004 | Iwashita et al. | |
| 6,823,590 | B2 | | 11/2004 | Uchiyama et al. | |
| 6,825,445 | B2 | | 11/2004 | Shalev et al. | |
| 6,826,835 | B1 | | 12/2004 | Wong | |
| 6,951,056 | B2 | | 10/2005 | Kameoka et al. | |

* cited by examiner

*Primary Examiner*—Ghassem Alie
*Assistant Examiner*—Bharat C Patel

(57) ABSTRACT

This new electric razor has a set of multiple shaving knives (12), having dual cutting edges longitudinally on both sides of knife, and rotating and reciprocating simultaneously on the inner surface of a cylindrical shaving screen (11). This mechanism creates a 3-dimensionally elliptical motion of the shaving knives that effectively slices hair off (not chopping) and provides a smooth and comfortable shave with minimum skin irritation. The cylindrical shaving screen (11) and the main body (19) containing a rotating cup (16), a motor (17) and power source (18) forms an inherently ergonomic, angled shape, which is also slim and compact overall for convenient use and easy carrying. This razor has a 360 degree effective shaving screen surface and can be used in wet or dry environments. Cleaning the shaving head screen requires no disassembly and can be done easily under running water.

3 Claims, 2 Drawing Sheets

Illustration:

Hair-Slicing

Illustration:

HAIR-SLICING ELECTRIC RAZOR

CROSS-REFERENCE TO RELATED APPLICATIONS

This application claims the benefit of provisional patent application Ser. No. 60/850,989, filed Oct. 11, 2006 by the present inventor.

FEDERALLY SPONSERED RESEARCH

Not applicable

SEQUENCE LISTING OR PROGRAM

Not applicable

1. Field of Invention

This invention relates to an electric shaving device having a new shaving mechanism and mechanical structure to provide comfortable hair shaving with minimum skin irritation and convenient maintenance of the device.

2. Background and Prior Art

Electric shavers are convenient and widely used, however, their hair shaving mechanisms have inherent short comings. Basically, most existing electric razors use a hair-chopping mechanism. When a cutting edge hits a hair stem caught in a hole of a shaving screen, it pulls hair up and chops off or tears off the hair. This cutting mechanism irritates skin and can result in an uncomfortable skin rash for sensitive skins.

There are many existing electric shavers with variety of cutting edge designs, however, the basic mechanisms are all similar. For some recent examples, Kameoka, etal. (U.S. Pat. No. 6,951,056) described a cutting edge having a slightly broad surface that contacts with an outer cutter, Wong (U.S. Pat. No. 6,826,835 B1) described a 2-head shaver with a similar hair cutting mechanism to others, Shalev, et al. (U.S. Pat. No. 6,825,445) described a cutting mechanism using heating elements with a complex heat control system, Uchiyama, et al. (U.S. Pat. No. 6,823,590) described rotary cutting elements, Iwashita, et al (U.S. Pat. No. 6,789,322) described a switching system for moving the shaving head up/down with a similar cutting mechanism, Oswald (U.S. Pat. No. 6,675,480) described oscillating cutting elements and a shearing head, Gerasimov , et al used multiple rotting circular cutting elements having a shallow cup shape under a flat circular screen, Zucker (U.S. Pat. No. 6,442,840 B2) described a cutting edge adopted on a roller under a half circular screen, Ilkhanov (U.S. Pat. No. 6,154,962) described cutting elements having a flat elliptical shape rotating by a center shaft under half circular screen head, Tezuka, et al (U.S. Pat. No. 5,678,313) described a triple headed shaver, Ascoli (U.S. Pat. No. 4,115,920) used all flat and circular shaped cutting elements arranged vertically to and under curved cutting screen, and they are oscillating to each other horizontally, Yamada, et al (U.S. Pat. No. 4,058,749) also used basically flat semi-circular cutting elements and half circular screen, Meyer (U.S. Pat. No. 3,947,961) used multiple cutting element arranged vertically under a curved screen, Shoemaker (U.S. Pat. No. 3,143,797) described a cylindrical shearing element having multiple small triangular openings and multiple vertically arranged cutting elements which rotate and reciprocate, Frith (U.S. Pat. No. 3,027,635) described a helical cutting elements rotating in a cone shaped or cylindrical shape screen, Page (U.S. Pat. No. 2,440,114) described a rotating cutting elements under half circular outer cutting element, Hall (U.S. Pat. No. 2,423,595) described multiple circular cutting discs by a motor and frictional wheel mechanism under a round comb shaped outer cutting head, and Jepson (U.S. Pat. No. 2,220,800) described a device has partially perforated and curved cutting head which oscillates slowly and rotting inner cutting elements. These prior arts, all use a similar hair pulling and chopping mechanism. Also, most conventional electric shavers are bulky and the effective shaving head surface is limited, and cleaning the shaving head is cumbersome.

OBJECTIVES AND ADVANTAGES

The present invention does not use a hair chopping mechanism, instead it uses a hair-slicing mechanism which is similar to blade shaving. It gives users a more comfortable and smoother hair shaving experience and avoiding skin irritation.

Several additional objectives and advantages are:

1. to provide a shaving head with a cylindrical shape and 360 degrees of effective shaving screen surface,
2. to provide a mechanism that makes the shaving knife set move in a three dimensionally elliptical motion, slicing hair caught in the holes of the shaving screen,
3. to provide a simple and easy way of cleaning the shaving head under running water without a complicated cleaning device or disassemble any part,
4. to provide a simple and easy way to replace shaving knives or shaving screen as needed,
5. to provide a smooth and quiet operation without gears or a vibration mechanism,
6. to provide an inherently ergonomic and angled shape with a slender and compact profile for convenient use and carrying.

SUMMARY

The present electric razor slices hair off like a blade shaving and is comprised of a cylindrical shaving screen head and a set of knives that moves in a 3-dimensionally elliptical motion on the inner surface of the cylindrical shaving screen.

DRAWINGS—FIGURES

In the drawings, closely related parts of a figure have the same part number with different alphabetical suffixes.

REFERENCE NUMERALS FOR THE DRAWINGS

11 Shaving screen

Figure 2:
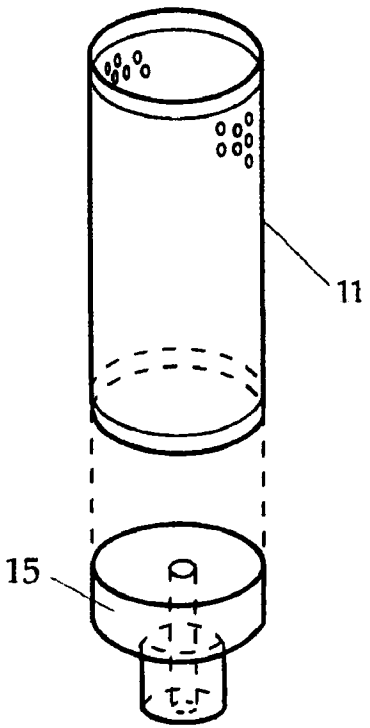
FIG. 2 shows a shaving screen and an adaptor to the head of device.

12 Shaving knife having flat and dual cutting edges longitudinally

12*a* Pins on knife

13 Shaving knife holder

14 Moving shaft, L-shape

15 Shaving screen adopter

16 Rotating cup

16*a* Moving shaft anchoring position

17 Motor

18 Power source (battery)
19 Main body
20 Switch
Head of a device
Small spring

DETAILED DESCRIPTION

Figure 1:
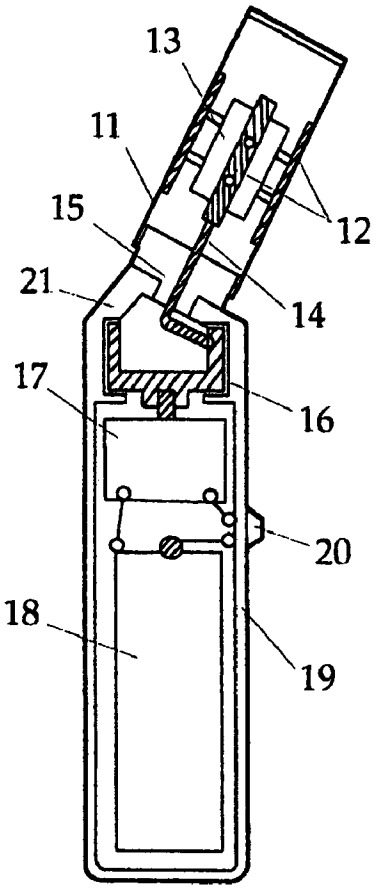
FIG. 1 shows an overall vertical cut through view of the internal structure including a knife set, motor, power source, etc. of the device.
Figure 3:
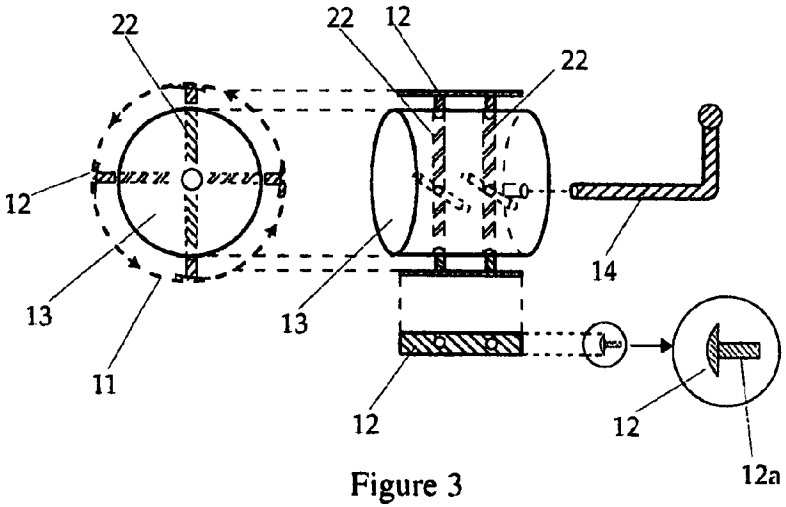
FIG. 3 shows a detailed structure and a flat knife shape.
Figure 5:
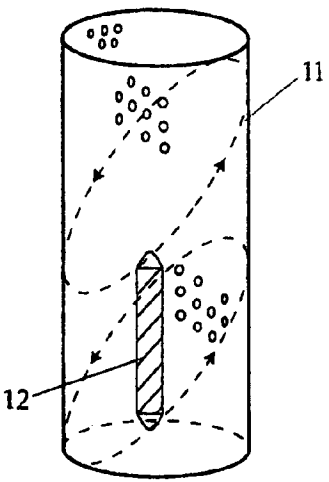
FIG. 5 shows a rotation trace of a flat knife on inner surface of a cylindrical shaving screen.
Figure 4:
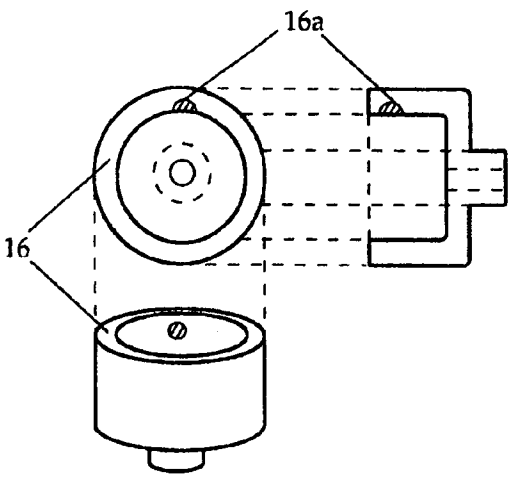
FIG. 4 shows a detailed rotation cup design.

The preferred embodiment of the present invention is illustrated in FIG. 1, which shows an overall view of the internal structure of the device. The basic mechanism of this new electric razor includes a set of shaving knives (12) rotates elliptically around the inner surface of the cylindrical shaving screen (11), while maintaining the knife set in a parallel orientation to the length of the cylindrical screen (11). This movement is generated as follows: when the rotating cup (16) in the head of the device (21) attached to a motor (17) rotates, the short arm of the L-shaped moving shaft (14) moveably anchored at (16*a*) on the inner wall of the rotating cup (16) turns along with the cup (16). The longer arm of the moving shaft (14) moves up/down so that it rotates and reciprocates simultaneously. This motion makes the knife holder (13) attached to the end of the long arm of the moving shaft (14) rotate and reciprocate simultaneously. Multiple shaving knives (12) are loosely adopted around the knife holder (13) and the knife set moves in a 3-dimensinally elliptical motion around the inner surface of the cylindrical shaving screen (11). FIG. 2 shows the cylindrical screen (11) made of a hard and thin metal and an adopter (15) to the head of the device (21). FIG. 3 shows a preferred embodiment of the shaving knife holder (13) and the knife made of hard steel. The elongated flat knife has a sharp shaving edge on both sides, and the surface of each knife in contact with the cylindrical shaving screen has the same curvature as the inner surface curvature of the screen to provide a smooth sliding movement and clean hair slicing. Each knife has 2 pins (12*a*) on the mid area and the pins are snugly adapted in the holes of the knife holder (13). The knives are in close contact with the screen by small springs (22). The end of the long arm of the L-shaped moving shaft (14) made of hard steel, is firmly fixed on one end of the knife holder (13) while the end of the short arm is moveably anchored at the inner wall of the rotating cup (16*a*). FIG. 4 shows a preferred shape of the rotating cup (16) made of hard plastic or light metal and indicates a preferred position (16*a*) for anchoring the short end of the moving shaft (14). FIG. 5 shows the moving traces of the shaving knife (12) on the inner surface of the cylindrical shaving screen (11). The shaving edge of the knife is oriented and maintained to be parallel to the length of the shaving screen and slides along the inner surface of the shaving screen in a three dimensionally elliptical motion in close contact to the screen.

OPERATION

When the motor (17) turns, the rotating cup (16) in the head of the device (21) rotates and the short arm of the moving shaft (14) anchored on the inner wall of the rotating cup turns and the long arm of the moving shaft (14) rotates and slides up/down, (i.e. reciprocation) because of the angled orientation of the long arm of the moving shaft (14) from the rotation axis of the rotating cup (16). The reciprocating distance is proportional to the diameter, d of the rotating cup (16) and the angle of the long arm of the moving shaft (14) with respect to the rotating axis of the rotating cup (16). The approximate relationship between the reciprocating distance (D), the angle (A) between the shaving screen and the motor axis and the cup diameter (d) can be expressed as: D−d tan A. Accordingly, the shaving knife set moves in a rotation and reciprocation motion simultaneously, which causes the shaving knives to move 3-dimensionally elliptical motion. The shaving knife surface is sliding on the inner surface of the cylindrical screen in close contact by means of small spring (22).

CONCLUSION

Ramification and Scope of the Invention

Thus, this invention provides an effective and comfortable hair-shaving device in wet or dry environments with minimum skin irritation. The device can be cleaned by simple rinsing with running water. The operation is smooth and quiet. It is also slim and compact with ergonomic holding handle for easy use and carrying.

While the above description contains many specifics, these should not be construed as a limitation on the scope of the invention, but rather as an example of one preferred embodiment thereof. Many other variations and uses are possible. For example, the simultaneous rotation/reciprocation mechanism in this device can be generated by a cylindrical cam mechanism, and the mechanism can be applied to other devices such as a toothbrush, rod saw, etc. To increase the rotation power, a gear head motor can be used and a rechargeable power source can be adopted. Accordingly, the scope of the invention should be determined not by the embodiment illustrated, but by the appended claims and their legal equivalent.

I claim:

1. An electric razor comprising: a shaving head having a smooth cylindrical shaving screen, said shaving head including at least a set of flat shaving knives, a shaving screen adaptor, a shaving knives holder;

wherein a hair slicing mechanism having a L-shape moving shaft; a rotating cup having an anchoring position; an electric motor for rotating said rotating cup; and a power source for supplying power to said electric motor;

wherein said shaving screen has a seamless and hard metallic mesh with a complete circular cylindrical shape having 360° of effective shaving surface, said shaving screen is mounted on the screen adaptor;

wherein said shaving knives are elongated flat hard metal having dual shaving edges on both sides of each knife, and each knife is secured to the shaving knife holder by a pair of resilient elements and a pair of fasteners;

wherein L-shape moving shaft having a short arm and a long arm, the short arm of the L-shape moving shaft is anchored into the anchoring position of the rotating cup in a manner that the shaving knives simultaneously rotate and reciprocate in three dimensional elliptical motion around the inner surface of the shaving screen; and wherein the long arm of the L-shape moving shaft rotatably connected to the knife holder; said shaving knives are mounted on the knife holder and closely contacting on flat to the inner surface of said shaving screen.

2. The electric razor according to claim 1, wherein the at least the set of the flat knives comprising two pairs of flat shaving knives.

3. The electric razor according to claim 1, wherein the resilient elements are springs.

* * * * *